US009138905B2

(12) United States Patent
Daul

(10) Patent No.: US 9,138,905 B2
(45) Date of Patent: Sep. 22, 2015

(54) METHOD FOR CALIBRATING THE POSITION OF THE SLITTER BLADES OF A SLITTER-WINDER

(71) Applicant: Michael J. Daul, Appleton, WI (US)

(72) Inventor: Michael J. Daul, Appleton, WI (US)

(73) Assignee: Valmet Technologies, Inc., Espoo (FI)

( * ) Notice: Subject to any disclaimer, the term of this patent is extended or adjusted under 35 U.S.C. 154(b) by 125 days.

(21) Appl. No.: 13/774,382

(22) Filed: Feb. 22, 2013

(65) Prior Publication Data

US 2014/0240696 A1 Aug. 28, 2014

(51) Int. Cl.

| | |
|---|---|
| ***G01B 21/16*** | (2006.01) |
| ***B26D 1/24*** | (2006.01) |
| ***B26D 7/26*** | (2006.01) |

(52) U.S. Cl.

CPC ..... *B26D 1/245* (2013.01); *B26D 7/2635* (2013.01)

(58) Field of Classification Search

CPC .... G01B 11/14; G01B 11/002; G01B 11/026; G01B 11/272; G01B 11/0608; G01B 11/028; G01B 11/005; G01B 21/045; G01B 21/16; G01B 21/04; G01B 5/205; G01C 15/002; G01C 15/004; G01C 15/00; G03F 7/70775

USPC ..... 356/614, 622, 620, 399, 4.01, 400, 498, 356/28, 72–73; 250/559.29, 559.3

See application file for complete search history.

(56) References Cited

U.S. PATENT DOCUMENTS

| | | | | |
|---|---|---|---|---|
| 4,346,994 | A * | 8/1982 | Cruz | 356/139.03 |
| 8,281,694 | B2 * | 10/2012 | Okihara | 83/13 |
| 2003/0019338 | A1 * | 1/2003 | Berne et al. | 83/13 |
| 2003/0063294 | A1 * | 4/2003 | Medberry et al. | 356/615 |
| 2003/0205117 | A1 * | 11/2003 | Flaherty et al. | 83/13 |
| 2004/0221699 | A1 * | 11/2004 | Adachi et al. | 83/174.1 |
| 2012/0048090 | A1 * | 3/2012 | Etter et al. | 83/473 |
| 2013/0301049 | A1 * | 11/2013 | Teague | 356/400 |

FOREIGN PATENT DOCUMENTS

| | | | | |
|---|---|---|---|---|
| EP | 1647377 B1 * | 2/2007 | | B26D 5/02 |
| WO | WO 2009156566 A1 * | 12/2009 | | B26D 7/26 |

* cited by examiner

*Primary Examiner* — Tarifur Chowdhury
*Assistant Examiner* — Mohamed Amara
(74) *Attorney, Agent, or Firm* — Stiennon & Stiennon

(57) ABSTRACT

The positions of the slitter blades of a slitter-winder are calibrated using a laser to perform measurement and calibration of the fiber web cutting point of each slitter blade pair. Measurement and calibration is preformed on the top slitter blade of each of a multiplicity of slitter blade pairs one after another. The laser measures one slitter blade of each slitter blade pair while they are engaged. The slitter blade pairs between the laser and the slitter blade pair being measured are not engaged. Carriages which support the slitter blades have position sensors which the laser measurements calibrate and the blade pair positions are measured and the carriage positions are read simultaneously. The cutting edges of the slitter blades are sharpened to have straight sides and the laser measurement system is located so the laser beam is directed to the straight side.

16 Claims, 3 Drawing Sheets

METHOD FOR CALIBRATING THE POSITION OF THE SLITTER BLADES OF A SLITTER-WINDER

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a slitter-winder of a fiber web production line in general and in particular to a method for calibrating the position of the slitter blades of a slitter-winder.

It is known that a fiber web, e.g. paper, is manufactured in machines which together constitute a paper-manufacturing line which can be hundreds of meters long. Modern paper machines can produce over 450,000 tons of paper per year. The speed of the paper machine can exceed 2,000 m/min and the width of the fiber web can be more than 11 meters.

In paper-manufacturing lines, the manufacture of paper takes place as a continuous process. A fiber web completing in the paper machine is reeled by a reel-up around a reeling shaft, i.e. a reel spool, into a parent roll the diameter of which can be more than 5 meters and the weight more than 160 tons. The purpose of reeling is to modify the fiber web manufactured as planar to a more easily processable form. On the reel-up located in the main machine line, the continuous process of the paper machine breaks for the first time and shifts into periodic operation.

The web of the parent roll produced in paper manufacture is full-width and even more than 100 km long, so it must be slit into partial webs with suitable width and length for the customers of the paper mill and wound around cores into so-called customer rolls before delivering them from the paper mill. This slitting and winding up of the web takes place in an appropriate separate machine, i.e. a slitter-winder.

On the slitter-winder, the parent roll is unwound, and the wide web is slit on the slitting section into several narrower partial webs which are wound up on the winding section around winding cores, such as spools, into customer rolls. When the customer rolls are completed, the slitter-winder is stopped and the wound rolls, i.e. the so-called set, is removed from the machine. Then, the process is continued with the winding of a new set. These steps, termed a set change, are repeated in sequences periodically until paper runs out of the parent roll, at which point a parent roll change is performed and the operation starts again with the unwinding of a new parent roll.

In the slitter-winders of fiber web machines a fiber web is slit in the longitudinal direction i.e., in the machine direction, into several component webs between a pair of slitter blades comprising a top slitter blade and a bottom slitter blade. The width of the component webs to be slit by the slitter blades and thus the position of the slitter blades can vary to a great extent when different slitter blade settings are used, depending on the set widths of the rolls to be produced. The slitter blades have to be positioned, in the lateral direction i.e., the cross machine direction of the web, in the right slitting position corresponding to the desired roll widths. In order to produce component webs of the desired width the slitter blades of the slitter-winder are spaced apart as desired in the cross machine direction of the paper or board web, that is, a change of settings is carried out.

As to prior art related to the invention, reference is made to U.S. Pat. No. 4,548,105, which discloses a method and a system for observing a position. This publication describes the use of the method in a system used in the slitting of a paper web. In this system to observe the position of the slitting device a measuring device is used which is in a position arrangement which comprises actuating members for controlling and performing the movement of the measuring device in the cross machine direction of the web and which system comprises at least one limiter for limiting the operation of the measuring device along the distance between the extreme positions such that one extreme position serves as the datum position for the determination. An observing device in both directions of movement observes at least one member of the slitting device. The system comprises drive means for the actuating members and moving devices performing a corrective movement of a movable device or member. The position of the slitter blades are determined when the machine is stopped by means of forgoing arrangement, so as to minimize the duration of the standstill.

It is known of prior art to measure the position of slitter blades used in slitting by a carriage-type arrangement, in which a sensor is placed in a moving carriage so the sensor determines by optic or magnetic measurement, the position of the slitter blades. The measurements so determined are used in connection with the changing of slitter blade settings. In DE application publication 102007047890 a device is disclosed that has a magnetic measuring system, in which position detection devices are connected with the carriages of the slitter blades, and a magnetic band which is used to determine position extends over the path of the carriages.

In DE application publication 102007000685 is disclosed an arrangement for position determining of slitter blades of a slitter-winder in which the position determining device comprises a magnetostrictive measuring system integrated in the guides of the slitter blade carriers.

In EP patent publication 1647377 is disclosed a slitter blade arrangement, in which at least one light-emitting element, i.e., a laser, which emits visible radiation is arranged so as to be adjustable, the light beam of the laser is oriented to a desired position for a cutting blade, the laser producing a mark, that is a spot of light, which corresponds to the position to which the cutting blade is to be directed. The laser can be used to produce a fan beam which forms a line in the cutting direction i.e., the machine direction, which marks a selected position for a slitter blade.

In a prior art application using a magnetic measurement, each slitter blade carriage is equipped with a fixed permanent magnet, and the distance between the permanent magnet and the slitter blade is constant, and the position of the permanent magnet is measured by means of a magnetic measuring device, thereby establishing the position of the slitter blade. In connection with the changing of slitter blade settings, information is also needed in addition to the information on the position of the slitter blade carriage. When replacing slitter blades with new blades or after the detachment and grinding of the slitter blades, position information of the distance between the slitter blade edge and the magnet of the slitter blade carriage is needed, without which no exact information on the position of the slitter blade is available based on the results from the measurement methods described above. The slitter blade edge also wears, which leads to inaccuracy when using the above-mentioned measurement methods. In the above-described situations, when prior art applications have been used, there has been a need to carry out so-called tuning runs in order to determine the position of the slitter blade edge.

Such methods and devices for specifying the position of the slitter blades are shown in U.S. Pat. No. 7,086,173 where the slitter blades are arranged in carriages fastened to guides, the position of which is specified. The position of an edge of the bottom slitter blade is calibrated with a separate calibration tool, by bringing the moving calibration tool to the point of the slitting edge of the bottom slitter blade, and the position of the calibration tool is measured. Based on these two measurements (carriage position and calibration tool position), the position of the slitter blade is specified.

In WO publication 2009156566 there is disclosed a method for calibrating the position of slitter blades of a slitter-winder in which there is at least one stationary fixed point of the frame of the slitter-winder. An edge of at least one slitter blade is positioned in relation to the position of the slitter blade carriage. Each fixed point is in the cross machine direction of the frame such that each slitter blade being positioned extends to at least one fixed point. According to one embodiment a sensor measures the position of the edge of the slitter blade with respect to a fixed point. The sensor measures the position of the edge of the slitter blade with respect to the fixed point and the distance between the edge and the slitter blade carriage is specified because the position of the slitter blade carriage is continuously known. Based on knowing the distance between the edge and the slitter blade carriage, the slitter blade can be positioned by positioning the carriage. A variation of this embodiment is disclosed in which the sensor is a distance sensor which measures the position of the slitter blade, preferably the edge, at the moment of calibration. For specifying the position of the slitter blade in this embodiment the slitter blade can be spaced from the sensor.

It is an object of the invention to provide a solution for eliminating or at least minimizing the disadvantages described above.

An object of the invention is to provide an easy-to-use and reliably operating method for calibrating the position of the slitter blades of a slitter-winder.

SUMMARY OF THE INVENTION

The invention provides a method for calibration of positions of slitter blades of a slitter-winder in a fiber web production line in which a laser is used. The calibration is performed while the slitter is in standstill and no fiber web is running or being slit between the slitter blades. Laser measurement for calibration is provided at the fiber web cutting point of a slitter blade, preferably the top slitter blade of a pair of slitter blades, and the laser measurement calibration is used to calibrate the slitter blade carriage position sensors. To calibrate the slitter system a laser measures one slitter blade of each slitter blade pair when they are engaged without a web present. Slitter blade pairs between the laser and the slitter blade pair being measured are separated to allow the laser beam to reach the furthest pair, and one-by-one the pairs of slitter blades progressively closer to the laser are closed and measured. Simultaneously with measuring each slitter blade pair the carriage positions are read. The shape of slitter blades is typically such that the cutting edge is sharpened with one side inclined and the other side straight. The laser measurement system is located such that the laser beam is directed to the slitter blade to its straight side thus resulting in further accuracy to the measurement.

The calibration of positions of slitter blades is typically needed after replacement of a slitter blade(s) or after replacement of a sensor(s) on a carriage(s) or after a power failure or a corresponding disturbance in operation but not in connection with each repositioning of the slitter blades for the selected slitting position corresponding to the desired roll widths.

The method for calibrating the position of slitter blades of a slitter-winder in a fiber web production line, in which slitter blades are moved by slitter blade carriages mounted on cross machine direction guides of the slitter-winder. The cross machine direction is defined as perpendicular to the running direction or machine direction of the fiber web. The slitter blades thus are moved to slitting positions for slitting the fiber web into partial webs which extend in the machine or longitudinal direction of the fiber web. At least one of the slitter blades of each slitter blade pair is movable upwards and downwards in the carriage in relation to its distance to the other slitter blade of the slitter blade pair for engaging and correspondingly opening each slitter blade pair. The positions of the carriages are measured by slitter blade carriage sensors. Each slitter blade pair position is measured and calibrated, with a laser sensor which measures and calibrates the positions of one slitter blade of each slitter blade pair. The measurement of said calibration is performed while the slitter-winder is at a standstill and no fiber web is running or being slitted between the slitter blades. The measurement and said calibration is provided at the fiber web cutting point of each slitter blade pair used to calibrate the slitter blade carriage position sensors. To calibrate the system the laser sensor measures the distance to one slitter blade of each slitter blade pair when the pair is engaged, while other slitter blade pairs between the laser sensor and the slitter blade pair are not engaged and so do not block the laser beam from reaching the one slitter blade which is being measured.

According to an advantageous feature of the invention the measurement and the calibration by the laser sensor is provided to measure and calibrate the positions of each slitter blade pair one-by-one.

According to another advantageous feature the slitter blade carriage positions are defined simultaneously with said measurement and said calibration by the laser sensor.

According to a further advantageous feature the laser beam is directed to the straight side of the slitter blade for increased accuracy of the blade position measurement.

The invention and its further objects, features, and advantages may be more fully understood by reference to the following drawings.

DESCRIPTION OF THE PREFERRED EMBODIMENTS

During the course of this description like numbers and signs will be used to identify like elements according to the different views which illustrate the invention.

Figure 1:
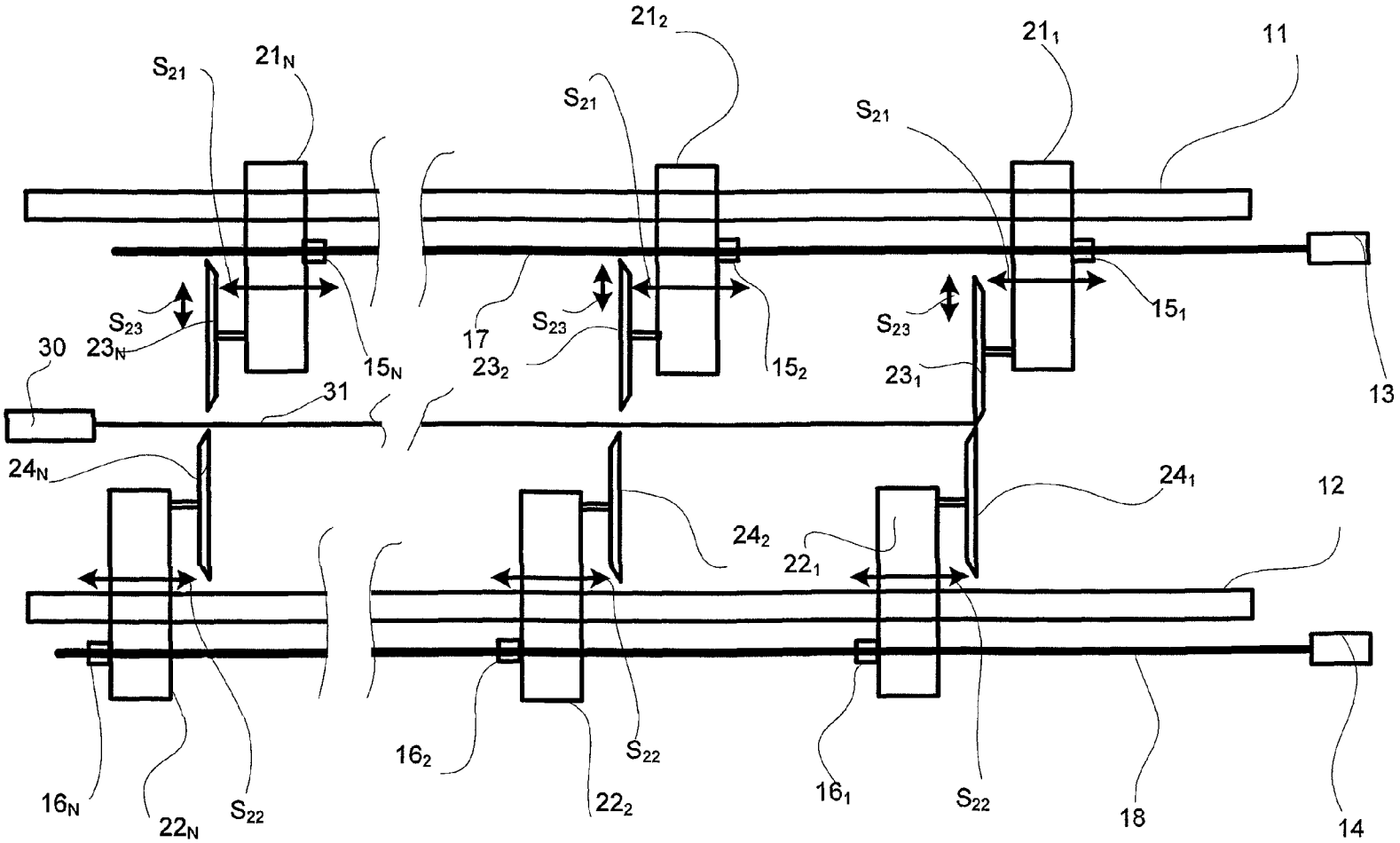
FIG. 1 is a schematic view of the slitter of this invention while the distance to the slitter blade furthest from the laser in a first pair of slitter blades furthest from the laser is measured.
Figure 2:
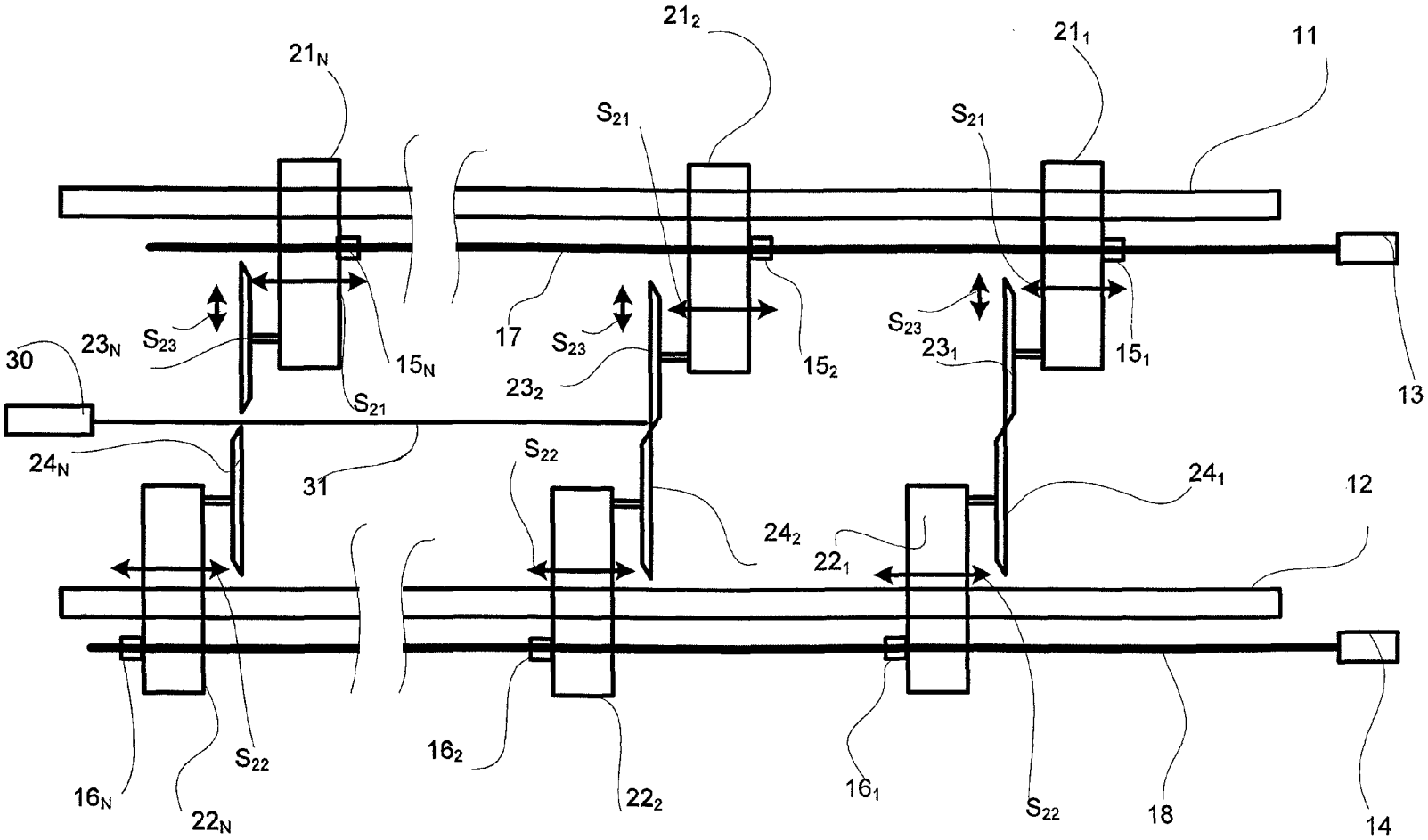
FIG. 2 is an a schematic view of the slitter of this invention while the distance to the slitter blade furthest from the laser in a second pair of slitter blades closer to the laser is measured.
Figure 3:
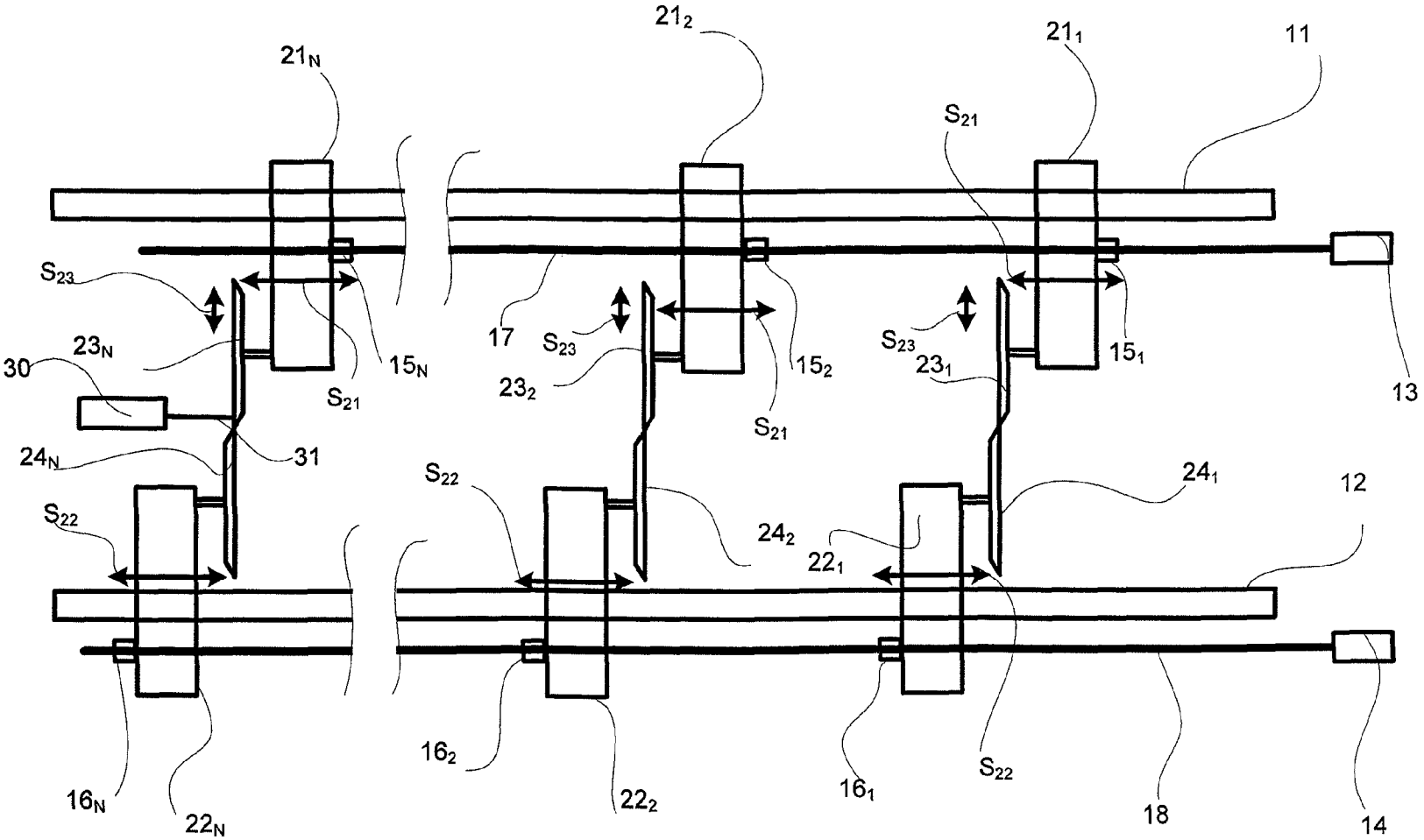
FIG. 3 is an a schematic view of the slitter of this invention while the distance to the slitter blade furthest from the laser in a third pair of slitter blades closest to the laser is measured.

FIGS. 1-3 show three of the top blades $\mathbf{23}_1$, $\mathbf{23}_2$, $\mathbf{23}_N$ and bottom $\mathbf{24}_1$, $\mathbf{24}_2$ 2, $\mathbf{24}_N$ slitter blade pairs used in slitting. Typically there are 15-25 pairs of slitter blades in a slitter for slitting the fiber web longitudinally into partial webs in accordance with the desired widths of customer rolls (partial web rolls) to be produced in the slitter-winder. Each of the top slitter blades $\mathbf{23}_1$, $\mathbf{23}_2$, $\mathbf{23}_N$ is attached to a top slitter blade carriage $\mathbf{21}_1$, $\mathbf{21}_2$, $\mathbf{21}_N$, correspondingly, which top slitter blade carriages $\mathbf{21}_1$, $\mathbf{21}_2$, $\mathbf{21}_N$ are arranged to be movable in a cross machine direction as shown by arrows $S_{21}$ in relation to the travel direction i.e., the machine direction, of the web along an upper guide 11, and each of the bottom slitter blades $\mathbf{24}_1$, $\mathbf{24}_2$ 2, $\mathbf{24}_N$ are attached to a bottom slitter blade carriage $\mathbf{22}_1$, $\mathbf{22}_2$, $\mathbf{22}_N$, correspondingly, which bottom slitter blade carriages $\mathbf{22}_1$, $\mathbf{22}_2$, $\mathbf{22}_N$ are arranged to be movable in the cross machine direction as shown by arrows $S_{22}$ in relation to the travel direction of the web along a lower guide 12. Actuators (not shown) are connected to the top and bottom slitter blade carriages for providing the movement of the carriages to the desired positions for slitting.

As shown in FIGS. 1-3, each top and bottom slitter blade carriage $\mathbf{21}_1$, $\mathbf{21}_2$, $\mathbf{21}_N$; $\mathbf{22}_1$, $\mathbf{22}_2$, $\mathbf{22}_N$ is equipped with a position indicator, for example a position magnet $\mathbf{15}_1$, $\mathbf{15}_2$, $\mathbf{15}_N$; $\mathbf{16}_1$, $\mathbf{16}_2$, $\mathbf{16}_{1N}$, and a position sensor, for example a magnetostrictive position sensor 13, 14, is arranged below each guide 11, 12, respectively, by means of which sensor 13, 14 the position of the respective position magnet $\mathbf{15}_1$, $\mathbf{15}_2$, $\mathbf{15}_N$; $\mathbf{16}_1$, $\mathbf{16}_2$, $\mathbf{16}_N$ is measured. The principles of such an arrangement are known from U.S. Pat. No. 7,086,173. The sensors can also be some other sensors suitable for measuring a distance, such as inductive or pulse sensors. Also laser measurement can be applied.

In the method for calibration of positions of the slitter blades $\mathbf{23}_1$, $\mathbf{23}_2$, $\mathbf{23}_N$; $\mathbf{24}_1$, $\mathbf{24}_2$, $\mathbf{24}_N$ of the slitter-winder in a fiber web production line in which a laser sensor 30 and a laser beam 31 are provided for measurement and calibration. The calibration is performed while the slitter is at a standstill and no fiber web is running or being slitted between the slitter blades $\mathbf{23}_1$, $\mathbf{23}_2$, $\mathbf{23}_N$; $\mathbf{24}_1$, $\mathbf{24}_2$, $\mathbf{24}_N$. Laser measurement for calibration is provided at the cut point of a top slitter blade, $\mathbf{23}_1$, $\mathbf{23}_2$, $\mathbf{23}_N$ of a slitter blade pair, and the laser measurement calibration is used to calibrate the slitter blade carriage position sensors comprising the magnetostrictive position sensors 13, 14; and magnets $\mathbf{15}_1$, $\mathbf{15}_2$, $\mathbf{15}_N$; $\mathbf{16}_1$, $\mathbf{16}_2$, $\mathbf{16}_N$. To calibrate the system the laser 30 with the beam 31 strikes one slitter blade $\mathbf{23}_1$, $\mathbf{23}_2$, $\mathbf{23}_N$; of each slitter blade pair while the slitter blade pairs that are located between the slitter blade pair being measured and the laser sensor 30 are not engaged so that the laser beam 31 senses the engaged slitter blade $\mathbf{23}_1$. Advantageously the positions of the slitter blades $\mathbf{23}_1$, $\mathbf{23}_2$, $\mathbf{23}_N$ are measured one-by-one and the corresponding carriage positions are read simultaneously. As shown in the figures the laser sensor 30 is located such that a substantially straight side of the slitter blades $\mathbf{23}_1$, $\mathbf{23}_2$, $\mathbf{23}_N$ will be sensed by the laser beam 31. The shape of slitter blades is as shown in the figures and is typically such that the cutting edge is sharpened such that one side is inclined and the other side is straight and as mentioned the laser measurement system is located such that the laser beam 31 is directed to the straight side of the slitter blades $\mathbf{23}_1$, $\mathbf{23}_2$, $\mathbf{23}_N$ thus resulting in further accuracy to the measurement.

In FIG. 1 the top and bottom slitter blade pairs $\mathbf{23}_2$, $\mathbf{23}_N$; $\mathbf{24}_2$, $\mathbf{24}_N$ are unengaged and the top slitter blade $\mathbf{23}_1$ farthest from the laser 30 is calibrated by a laser measurement system including the laser 30 and the laser beam 31 which together comprise the laser sensor which sends the laser beam 31 that measures the position of the farthest top slitter blade $\mathbf{23}_1$ while it is positioned engaged with the corresponding bottom slitter blade $\mathbf{24}_1$ in a slitting position, i.e. contacting the bottom slitter blade.

After the measurement of the top slitter blade $\mathbf{23}_1$ the next farthest top slitter blade $\mathbf{23}_2$ is moved downwards as shown by arrow $S_{23}$ to a closed position for calibrating the second top slitter blade $\mathbf{23}_2$, which engages to the corresponding bottom slitter blade $\mathbf{24}_2$, as shown in FIG. 2 and after the measurement of the top slitter blade $\mathbf{23}_2$ the next top slitter blade (not shown) is measured and calibrated and correspondingly each top slitter blade is measured and calibrated until finally the last top slitter blade $\mathbf{23}_N$, which is closest to the laser beam is engaged with the corresponding bottom slitter blade $\mathbf{24}_N$ and is measured and calibrated as shown in FIG. 3.

The stages of calibrating measurement by the laser measurement system, comprising a laser 30 and the beam 31 it generates, can also be performed in reverse order, beginning from the closest top slitter blade $\mathbf{23}_N$ engaged with the corresponding bottom slitter blade $\mathbf{24}_N$ as shown in FIG. 3 which is then opened out of engagement so the next slitter blade pair (not shown) can be measured and calibrated as to its position and which is in turn opened out of engagement so the next slitter blade pair can be measured and calibrated and so on until finally the last top slitter blade $\mathbf{23}_1$ in engagement with the corresponding bottom slitter blade $\mathbf{24}_1$ is measured and calibrated as shown in FIG. 1.

According to the invention each top slitter blade is calibrated one-by-one by the laser measurement system 30, 31 and simultaneously the corresponding top and bottom slitter blade carriage $\mathbf{21}_1$, $\mathbf{21}_2$, $\mathbf{21}_N$; $\mathbf{22}_1$, $\mathbf{22}_2$, $\mathbf{22}_N$ positions are measured by the position sensor system 13; 14, $\mathbf{15}_1$, $\mathbf{15}_2$, $\mathbf{15}_N$; $\mathbf{16}_1$, $\mathbf{16}_2$, $\mathbf{16}_N$ for providing accurate information to a control system (not shown) which controls the movement of the slitter of the carriages, if needed. Thus the blade carriages $\mathbf{21}_1$, $\mathbf{21}_2$, $\mathbf{21}_N$; $\mathbf{22}_1$, $\mathbf{22}_2$, $\mathbf{22}_N$ are positioned for slitting the fiber web into the next set of partial webs with desired widths for the next set of customer rolls (partial web rolls). The calibration of the positions of the slitter blades is typically needed after replacement of a slitter blade(s) or after replacement of a sensor(s) of a carriage(s) or after a power failure or a corresponding disturbance in operation. Such calibration of the positions of the slitter blades is not needed with each routine positioning of the slitter blades to the slitting position corresponding to the desired roll widths.

While the invention has been described with reference to the preferred embodiments thereof, it will be appreciated by those skilled in the art that modifications can be made to the structure and elements of the invention without departing from the spirit and scope of the invention as a whole.

It is understood that the invention is not limited to the particular construction and arrangement of parts herein illustrated and described, but embraces all such modified forms thereof as come within the scope of the following claims.

I claim:

1. A method for calibrating the positions of slitter blades of a slitter-winder in a fiber web production line, where movement of the fiber web through the slitter-winder defines a machine direction, and a cross machine direction is defined perpendicular to the machine direction, wherein the slitter-winder has a plurality of cross machine direction arrayed slitter blade pairs, and at least one slitter blade of each slitter blade pair is mounted to a carriage for movement upwards and downwards with respect to the carriage for changing a distance with respect to a second slitter blade of the slitter blade pair for engaging and correspondingly opening each slitter blade pair, and wherein the carriage is mounted for movement in a cross machine direction on a guide of the slitter-winder to slitting positions for slitting the fiber web into partial webs in the machine direction of the fiber web, the method comprising the steps of:

measuring in each pair of slitter blades with a laser having a cross machine direction extending beam, a cross machine direction position of a first slitter blade engaged with a second slitter blade forming each pair of the plurality of slitter blade pairs, wherein the first slitter blade is mounted to a first carriage movable in the cross machine direction on a first guide in the slitter-winder, and wherein the second slitter blade is mounted to a second carriage movable in the cross machine direction on a second guide in the slitter-winder, wherein the measuring in each pair of slitter blades is conducted while the slitter-winder is in standstill and no fiber web is running, and wherein slitter blade pairs between the laser and the pair of slitter blades being measured are open so as not to block the laser beam from reaching the pair of slitter blades being measured;

measuring a position of each first carriage in the cross machine direction with a first carriage position sensor;

comparing the cross machine direction position of each first slitter blade, with the position of each first carriage in the cross machine direction as measured with the first carriage position sensor; and calibrating each first carriage position sensor, so that each first slitter blade can be positioned based on each first carriage position sensor.

2. The method of claim 1 wherein said measurement steps, said comparing step and said calibration step are performed with respect to each slitter blade pair one at a time.

3. The method of claim 1 wherein for each slitter blade pair the first slitter blade carriage position is measured with the first carriage position sensor with the laser simultaneously measuring the cross machine direction position of the first slitter blade of said slitter blade pair.

4. The method of claim 3 wherein the comparing of the cross machine direction position of the first slitter blade with the position of the first slitter blade carriage is performed simultaneously with the first carriage position measurement and the measurement of the cross machine direction position of each first slitter blade; and wherein the calibration of each of the first carriage position sensor is performed simultaneously with the first carriage position measurement and the measurement of the cross machine direction position of each first slitter blade.

5. The method of claim 1 wherein each first slitter blade has a straight side and the laser beam is directed to the straight side of each first slitter blade.

6. The method of claim 1 wherein the steps of measuring in each pair of slitter blades with the laser the cross machine direction position of the first slitter blade; measuring the position of each first carriage; comparing the cross machine direction position of each first slitter blade with the position of each first carriage; and calibrating each first carriage position sensor, are performed after replacement of at least one of the slitter blades or after replacement of at least one distance sensor, or after a power failure or a corresponding disturbance in operation of the slitter-winder.

7. The method of claim 1 wherein the laser beam is directed at a fiber web cutting point of each first slitter blade when engaged with one of the second slitter blades to form each pair of the plurality of slitter blade pairs;

wherein the second slitter blades in each pair of slitter blades are engaged with the first slitter blades, and each second slitter blade thus has the cross machine direction position of the first slitter blade with which it is engaged;

measuring a position of each second carriage in the cross machine direction with a second carriage position sensor;

comparing the cross machine direction position of each second slitter blade with the position of each second carriage in the cross machine direction as measured with the second carriage position sensor; and calibrating each second carriage position sensor, so that each second slitter blade can be positioned based on each second carriage position sensor.

8. The method of claim 1 wherein in each pair of slitter blades, each first slitter blade is positioned above the second slitter blade.

9. A method for calibrating the positions of slitter blades of a slitter-winder in a fiber web production line when the fiber web production line is at a standstill, where movement of the fiber web through the slitter-winder defines a machine direction, and wherein the slitter-winder has a plurality of slitter blade pairs and at least one slitter blade defining a first slitter blade of each slitter blade pair is mounted to a first carriage for movement upwards and downwards with respect to the carriage for changing a distance with respect to a second slitter blade of the slitter blade pair for engaging and correspondingly opening each slitter blade pair, and wherein the first carriage is mounted for movement in a cross machine direction on a guide of the slitter-winder to slitting positions for slitting the fiber web into partial webs in the machine direction of the fiber web, the method comprising the steps of:

directing a laser beam to extend parallel to and along a first guide to which the first carriage is mounted for movement in the cross machine direction so that the laser beam extends substantially in the cross machine direction;

measuring with the laser beam the cross machine direction position of a first slitter blade engaged with a second slitter blade forming a first pair of the plurality of slitter blade pairs, wherein the cross machine direction is perpendicular to the machine direction, and wherein the first slitter blade is mounted to the first carriage movable in the cross machine direction on the first guide in the slitter-winder, and wherein the second slitter blade is mounted to a second carriage movable in the cross machine direction on a second guide in the slitter-winder;

measuring a position of the first carriage in the cross machine direction with a first carriage sensor;

comparing the cross machine direction position of the first slitter blade engaged with the second slitter blade with the position of the first carriage in the cross machine direction as measured with the first carriage sensor; and calibrating the first carriage sensor, so that the first slitter blade can be positioned based on the first carriage sensor.

10. The method of claim 9 wherein said measurement steps, said comparing step and said calibration step are performed with respect to each slitter blade pair one at a time.

11. The method of claim 10 wherein in each pair of slitter blades, the first slitter blade is positioned above of and closer to the laser beam than the second slitter blade.

12. The method of claim 9 wherein for each slitter blade pair, the first slitter blade carriage position is measured with the first carriage sensor with the laser simultaneously measuring the cross machine direction position of the first slitter blade of said slitter blade pair.

13. The method of claim 12 wherein the comparing of the cross machine direction position of the first slitter blade with the position of the first slitter blade carriage is performed simultaneously with the first carriage position measurement and the measurement of the cross machine direction position of the first slitter blade; and wherein the calibration of the first carriage position sensor is performed simultaneously with the first carriage position measurement and the measurement of the cross machine direction position of the first slitter blade.

14. The method of claim 9 wherein the first slitter blade in each pair of slitter blades has a first straight side and the laser beam is directed to the first straight side of the first slitter blade, and the second slitter blade in each pair of slitter blades has a second straight side in engagement with the first straight side of the first slitter blade;

wherein the second slitter blades in each pair of slitter blades are engaged with the first slitter blades, and each second slitter blade thus has the cross machine direction position of the first slitter blade with which it is engaged;

measuring a position of each second carriage in the cross machine direction with a second carriage position sensor;

comparing the cross machine direction position of each second slitter blade with the position of each second carriage in the cross machine direction as measured with the second carriage position sensor; and calibrating each second carriage position sensor, so that each second slitter blade can be positioned based on each second carriage position sensor.

15. The method of claim 9 wherein the steps of measuring with the laser beam the cross machine direction position of the first slitter blade; measuring the position of the first carriage; comparing the cross machine direction position of the first slitter blade with the position of the first carriage; and calibrating the first carriage sensor, are performed after replacement of the first slitter blades or after replacement of the first carriage sensor, or after a power failure or a corresponding disturbance in operation of the slitter-winder.

16. The method of claim 9 wherein the laser beam is directed at a fiber web cutting point of the first slitter blade.

* * * * *